US011695197B2

(12) United States Patent
Lv et al.

(10) Patent No.: US 11,695,197 B2
(45) Date of Patent: Jul. 4, 2023

(54) RADIATING ELEMENT, ANTENNA ASSEMBLY AND BASE STATION ANTENNA

(71) Applicant: CommScope Technologies LLC, Hickory, NC (US)

(72) Inventors: Fusheng Lv, Suzhou (CN); Lei Yang, Suzhou (CN); Cheng Xue, Suzhou (CN)

(73) Assignee: CommScope Technologies LLC, Hickory, NC (US)

( * ) Notice: Subject to any disclaimer, the term of this patent is extended or adjusted under 35 U.S.C. 154(b) by 60 days.

(21) Appl. No.: 17/360,269

(22) Filed: Jun. 28, 2021

(65) Prior Publication Data

US 2021/0408672 A1 Dec. 30, 2021

(30) Foreign Application Priority Data

Jun. 30, 2020 (CN) ..... 202010611310.2

(51) Int. Cl.

| | |
|---|---|
| ***H01Q 1/24*** | (2006.01) |
| ***H01Q 21/00*** | (2006.01) |
| ***H01Q 5/42*** | (2015.01) |
| ***H01Q 1/50*** | (2006.01) |
| ***H01Q 1/48*** | (2006.01) |
| ***H01Q 1/38*** | (2006.01) |
| ***H01Q 5/48*** | (2015.01) |

(52) U.S. Cl.

CPC ..... *H01Q 1/246* (2013.01); *H01Q 1/38* (2013.01); *H01Q 1/48* (2013.01); *H01Q 1/50* (2013.01); *H01Q 5/42* (2015.01); *H01Q 5/48* (2015.01); *H01Q 21/0075* (2013.01)

(58) Field of Classification Search

CPC ..... H01Q 1/246; H01Q 1/38; H01Q 1/48; H01Q 1/50; H01Q 5/40; H01Q 5/42; H01Q 5/48; H01Q 5/49; H01Q 5/50; H01Q 21/0075; H01Q 21/062; H01Q 21/26

See application file for complete search history.

(56) References Cited

U.S. PATENT DOCUMENTS

| | | | | |
|---|---|---|---|---|
| 2019/0288406 | A1* | 9/2019 | Yang | H01Q 1/36 |
| 2022/0059929 | A1* | 2/2022 | Enkhbayar | H01Q 5/42 |
| 2022/0352649 | A1* | 11/2022 | Wu | H01Q 19/104 |

* cited by examiner

*Primary Examiner* — Robert Karacsony
(74) *Attorney, Agent, or Firm* — Myers Bigel, P.A.

(57) ABSTRACT

Radiating elements, antenna assemblies, and base station antennas including the same. For example, a radiating element is provided that includes a feed stalk and a radiator mounted on the feed stalk. The feed stalk includes a dielectric substrate, a first metal pattern printed on a first major surface of the dielectric substrate, and a second metal pattern printed on a second major surface of the dielectric substrate that is opposite the first major surface. The first metal pattern includes a first feed transmission line and a first feed welding region electrically connected to the first feed transmission line. The second metal pattern includes a second feed welding region electrically connected to the first feed welding region.

20 Claims, 5 Drawing Sheets

RADIATING ELEMENT, ANTENNA ASSEMBLY AND BASE STATION ANTENNA

CROSS-REFERENCE TO RELATED APPLICATION

The present application claims priority to Chinese Patent Application No. 202010611310.2, filed with the China National Intellectual Property Administration on Jun. 30, 2020, with the entire contents of the above-identified application incorporated by reference as if set forth herein.

TECHNICAL FIELD

The present invention generally relates to radio communications and, more particularly, to radiating elements, antenna assemblies and base station antennas for cellular communications systems.

BACKGROUND

Cellular communications systems are well known in the art. In a cellular communications system, a geographic area is divided into a series of regions that are referred to as "cells" which are served by respective base stations. The base station may include one or more base station antennas that are configured to provide two-way radio frequency ("RF") communications with mobile subscribers that are within the cell served by the base station.

In many cases, each base station is divided into "sectors". In perhaps the most common configuration, a hexagonally shaped cell is divided into three 120° sectors, and each sector is served by one or more base station antennas that have an azimuth Half Power Beam width (HPBW) of approximately 65°. Typically, the base station antennas are mounted on a tower structure, with the radiation patterns (also referred to herein as "antenna beams") that are generated by the base station antennas directed outwardly. Base station antennas often include a linear array or a two-dimensional array of radiating elements, such as crossed dipole or patch radiating elements.

Due to the growing demand for wireless communications, multi-band technology, Multiple-Input Multiple-Output (MIMO) technology, and beamforming technology have been rapidly developed to support different services. However, with the integration of more and more frequency bands and/or RF ports in one base station antenna, the antenna system, such as feed networks on a feed board, become more complex. The complex feed networks may increase the design difficulty, such as routing difficulty, and increase the size of the feed board, making the base station antenna larger and/or heavier, both of which are undesirable.

SUMMARY

Thus, one object of the present invention is to provide a radiating element, an antenna assembly and a related base station antenna capable of overcoming at least one drawback in the prior art.

Some embodiments include a radiating element. The radiating element may include a feed stalk. The element may include a radiator mounted on the feed stalk. The element may include where the feed stalk includes a dielectric substrate, a first metal pattern printed on a first major surface of the dielectric substrate, and a second metal pattern printed on a second major surface of the dielectric substrate that may be opposite the first major surface. The element may include where the first metal pattern includes a first feed transmission line, and a first feed welding region electrically connected to the first feed transmission line, and the second metal pattern includes a second feed welding region electrically connected to the first feed welding region.

In some embodiments, one or more of the following features may be included. The first feed welding region may be electrically connected to the second feed welding region via a metalized hole through the dielectric substrate. The first feed welding region and the second feed welding region may be provided on a support end of the feed stalk, where the feed stalk may be configured to mount to a feed board for the radiating element via the support end, and where the first feed welding region and the second feed welding region are configured to be welded to a feed board feed welding region on the feed board. The first feed transmission line may be configured as a feed balun. The feed balun may be printed integrally with the first feed welding region. The feed stalk includes a first feed stalk and a second feed stalk, where the radiator may include a first radiator mounted on the first feed stalk and a second radiator mounted on the second feed stalk, where the first feed stalk and the second feed stalk are arranged crosswise, and where the first feed welding region on one of the first feed stalk and the second feed stalk may be arranged facing the second feed welding region on the other feed stalk. The second metal pattern may include a first ground welding region, and a ground metal region may be electrically connected to the first ground welding region. The second feed welding region may be spaced apart from the first ground welding region and the ground metal region by a gap, within which metallization may be removed, so that the second feed welding region may be electrically isolated from the first ground welding region and the ground metal region. The first ground welding region and the second feed welding region are arranged side by side. The first ground welding region may be provided on a support end of the feed stalk, and the feed stalk may be configured to mount on a feed board for the radiating element via the support end, and where the first ground welding region may be configured to be welded to a ground pad on the feed board. The ground metal region may be printed integrally with the first ground welding region. The first feed transmission line may be configured as a feed line for RF signals and the ground metal region may be configured as a return line for RF signals. The ground metal region may be electrically connected to a feed end of the feed stalk via an inductive-capacitive filter circuit, and the feed end may be welded to the radiator.

Some embodiments include an antenna assembly. The antenna assembly may include a feed board. The assembly may include a radiating element mounted on the feed board, the radiating element may include: a first feed stalk, a first radiator mounted on the first feed stalk, a second feed stalk, and a second radiator mounted on the second feed stalk. The assembly may include where the first feed stalk and the second feed stalk each include a dielectric substrate. The assembly may include where a first metal pattern may be printed on a first major surface of the dielectric substrate and a second metal pattern may be printed on a second major surface of the dielectric substrate opposing the first major surface. The assembly may include where the first metal pattern includes a first feed transmission line and a first feed welding region electrically connected to the first feed transmission line. The assembly may include where the second metal pattern includes a second feed welding region electrically connected to the first feed welding region. The assembly may include where the first feed welding region on one of the first feed stalk and the second feed stalk faces the second feed welding region on the other feed stalk.

In some embodiments, one or more of the following features may be included. The antenna assembly where the feed board may be provided thereon with a first RF feed source and a second RF feed source; the antenna assembly may include: a second feed transmission line electrically connected to the first RF feed source; a first feed board feed welding region electrically connected to the second feed transmission line; a third feed transmission line electrically connected to the second RF feed source; and a second feed board feed welding region electrically connected to the third feed transmission line, where the first feed welding region on one of the first feed stalk and the second feed stalk may be welded to the first feed board feed welding region on the feed board, and where the second feed welding region on the other feed stalk may be welded to the second feed board feed welding region on the feed board. The radiating element may include a first radiating element and a second radiating element; the first RF feed source may be electrically connected to the second feed welding region on the first feed stalk of the first radiating element via a first branch of the second feed transmission line and the feed welding region on the feed board; the first RF feed source may be electrically connected to the first feed welding region on the first feed stalk of the second radiating element via a second branch of the second feed transmission line and the feed welding region on the feed board; the second RF feed source may be electrically connected to the first feed welding region on the second feed stalk of the first radiating element via a first branch of the third feed transmission line and the feed welding region on the feed board; and the second RF feed source may be electrically connected to the second feed welding region on the second feed stalk of the second radiating element via a second branch of the third feed transmission line and the feed welding region on the feed board. The first feed welding region may be electrically connected to the second feed welding region via a metalized hole. The first feed transmission line may be configured as a feed balun. The second metal pattern includes a first ground welding region and a ground metal region electrically connected to the first ground welding region, and the second feed welding region may be spaced from the first ground welding region and the ground metal region by a gap, within which metallization may be removed, so that the second feed welding region may be electrically isolated from the first ground welding region and the ground metal region. The feed board may be printed thereon with ground pads, to which the first ground welding region on each of the first feed stalk and the second feed stalk may be welded. Each of the ground pads may be electrically connected to a ground metal layer on the feed board.

Some embodiments include a base station antenna that includes one or more of the radiating elements or antenna assembly described herein.

The above are not the only embodiments provided by the present application, and other embodiments are disclosed herein, either explicitly or implicitly to those skilled in the art.

BRIEF DESCRIPTION OF THE DRAWINGS

The present invention will be explained in more detail below by specific embodiments with reference to the accompanying drawings. The schematic drawings are briefly described as follows.

DETAILED DESCRIPTION

Figure 1:
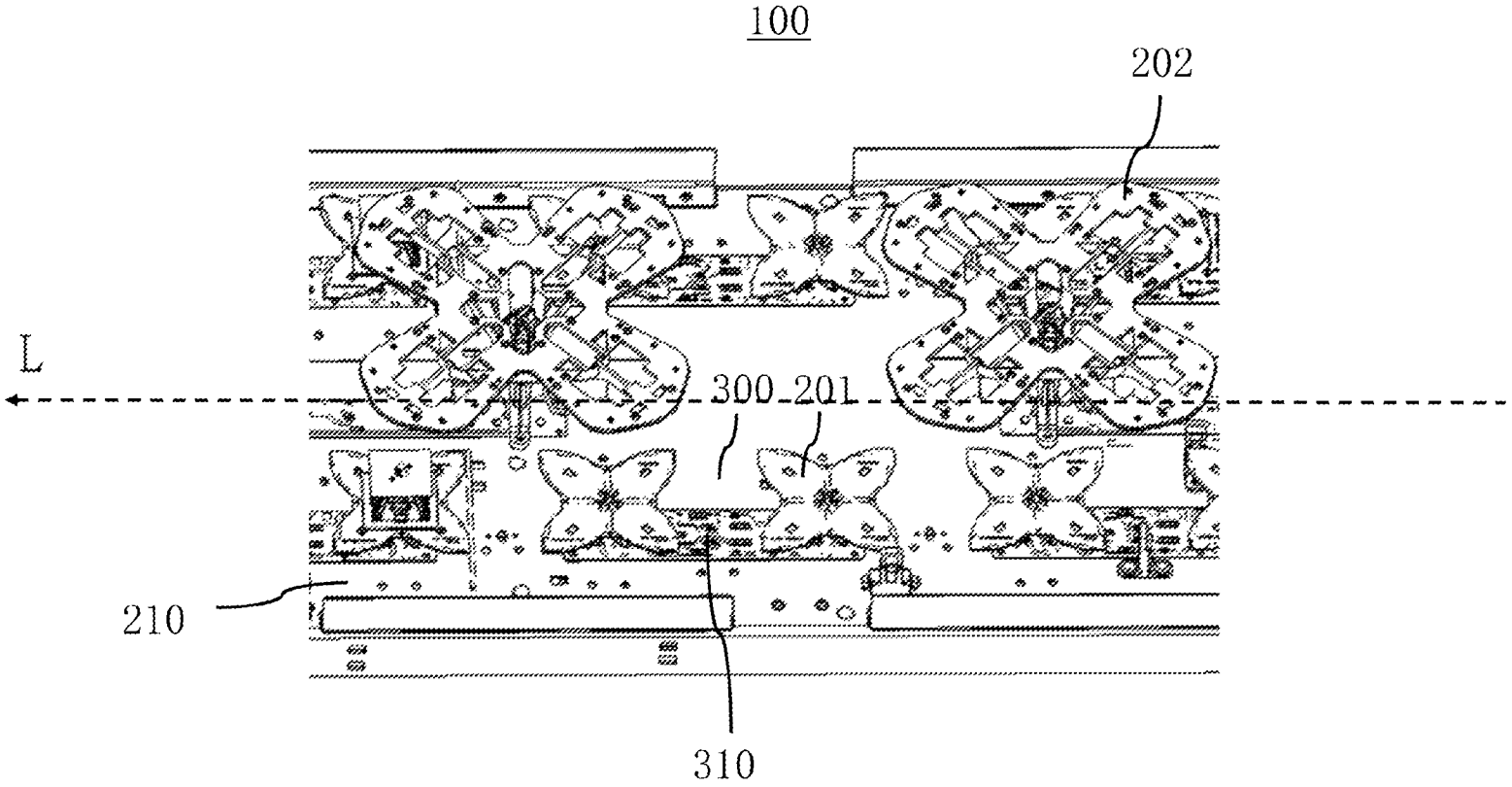
FIG. 1 is a schematic perspective view showing a portion of a base station antenna.

The present invention will be described below with reference to the drawings, in which several embodiments of the present invention are shown. It should be understood, however, that the present invention may be implemented in many different ways, and is not limited to the example embodiments described below. In fact, the embodiments described hereinafter are intended to make a more complete disclosure of the present invention and to adequately explain the scope of the present invention to a person skilled in the art. It should also be understood that, the embodiments disclosed herein can be combined in various ways to provide many additional embodiments.

It should be understood that, the wording in the specification is only used for describing particular embodiments and is not intended to limit the present invention. All the terms used in the specification (including technical and scientific terms) have the meanings as normally understood by a person skilled in the art, unless otherwise defined. For the sake of conciseness and/or clarity, well-known functions or constructions may not be described in detail.

In the specification, when an element is referred to as being "on," "attached" to, "connected" to, "coupled" with, "contacting," etc., another element, it can be directly on, attached to, connected to, coupled with or contacting the other element or intervening elements may also be present. In contrast, when an element is referred to as being "directly on," "directly attached" to, "directly connected" to, "directly coupled" with or "directly contacting" another element, there are no intervening elements present. In the specification, references to a feature that is disposed "adjacent" another feature may have portions that overlap, overlie or underlie the adjacent feature.

In the specification, words describing spatial relationships such as "up," "down," "left," "right," "forth," "back," "high," "low" and the like may describe a relation of one feature to another feature in the drawings. It should be understood that these terms also encompass different orientations of the apparatus in use or operation, in addition to encompassing the orientations shown in the drawings. For example, when the apparatus in the drawings is turned over, the features previously described as being "below" other features may be described to be "above" other features at this time. The apparatus may also be otherwise oriented (rotated 90 degrees or at other orientations) and the relative spatial relationships will be correspondingly altered.

Herein, the term "A or B" used through the specification refers to "A and B" and "A or B" rather than meaning that A and B are exclusive, unless otherwise specified.

The term "schematically" or "exemplary," as used herein, means "serving as an example, instance, or illustration," rather than as a "model" that would be exactly duplicated. Any implementation described herein as exemplary is not necessarily to be construed as preferred or advantageous over other implementations. Furthermore, there is no intention to be bound by any expressed or implied theory presented in the preceding technical field, background, summary or detailed description.

Herein, the term "substantially," is intended to encompass any slight variations due to design or manufacturing imperfections, device or component tolerances, environmental effects and/or other factors.

In this context, the term "at least a portion" may be a portion of any proportion, for example, may be greater than 10%, 20%, 30%, 40%, 50%, 60%, 70%, 80%, 90%, or even 100%.

In addition, certain terminology, such as the terms "first," "second" and the like, may also be used in the following description for the purpose of reference only, and thus are not intended to be limiting. For example, the terms "first," "second" and other such numerical terms referring to structures or elements do not imply a sequence or order unless clearly indicated by the context.

Further, it should be noted that, the terms "comprise/include," as used herein, specify the presence of stated features, steps, operations, elements, and/or components, but do not preclude the presence or addition of one or more other features, steps, operations, elements, components, and/or groups thereof.

FIG. 1 is a schematic perspective view showing a portion of a base station antenna 100. The base station antenna 100 may be mounted on a raised structure, such as antenna towers, utility poles, buildings, water towers and the like, with its longitudinal axis L extending substantially perpendicular to the ground. The base station antenna 100 is usually mounted within a radome (not shown) that provides environmental protection. The base station antenna 100 includes a reflector 210. The reflector 210 may include a metal surface that provides a ground plane and reflects electromagnetic waves reaching it, for example, the metal surface redirects the electromagnetic waves for forward propagation. The base station antenna 100 further includes mechanical and electronic components (not shown), such as a connector, a cable, a phase shifter, a remote electronic tilt (RET) unit, a duplexer and the like, which are often disposed on a rear side of the reflector 210.

As shown in FIG. 1, the base station antenna 100 may further include one or more antenna assemblies 300 that are disposed on a front side of the reflector 210. Each antenna assembly 300 may include a feed board 310 and one or more radiating elements mounted on the feed board 310. Each radiating element may be a first radiating element 201, the operating frequency band of which may be, for example, a middle frequency band (1695~2690 MHz) or a sub-band thereof (for example, 1695~2200 MHz, 2200~2690 MHz, etc.). An array of the first radiating elements 201 may be configured to generate a first antenna beam in the middle frequency band or a portion thereof. Additionally or alternatively, the radiating element may be a second radiating element 202, the operating frequency band of which may be, for example, a low frequency band (694-960 MHz) or a sub-band thereof. An array of the second radiating elements 202 may be configured to generate a second antenna beam in the low frequency band or a portion thereof. Additionally or alternatively, the radiating element may be a third radiating element (not shown), the operating frequency band of which may be, for example, a high frequency band (3.1~4.2 GHz) or a sub-band thereof. An array of the third radiating elements may be configured to generate a third antenna beam in the high frequency band or a portion thereof.

It should be understood that, the base station antenna 100 according to embodiments of the present invention may be any of a wide variety of different types of base station antennas such as, for example, a beamforming antenna, a multi-band base station antenna and/or a multi-input-multi-output (MIMO) antenna, and thus it will be appreciated that the antenna assemblies disclosed herein may be used in any of these types of antennas. Likewise, it will be appreciated that in other embodiments the radiating elements in the base station antenna 100 may operate in any other frequency band, not limited to the frequency bands exemplarily mentioned herein. In other embodiments, the base station antenna 100 may include only the first radiating element 201, the second radiating element 202, or the third radiating element.

Figures 2A, 2B, 2C:
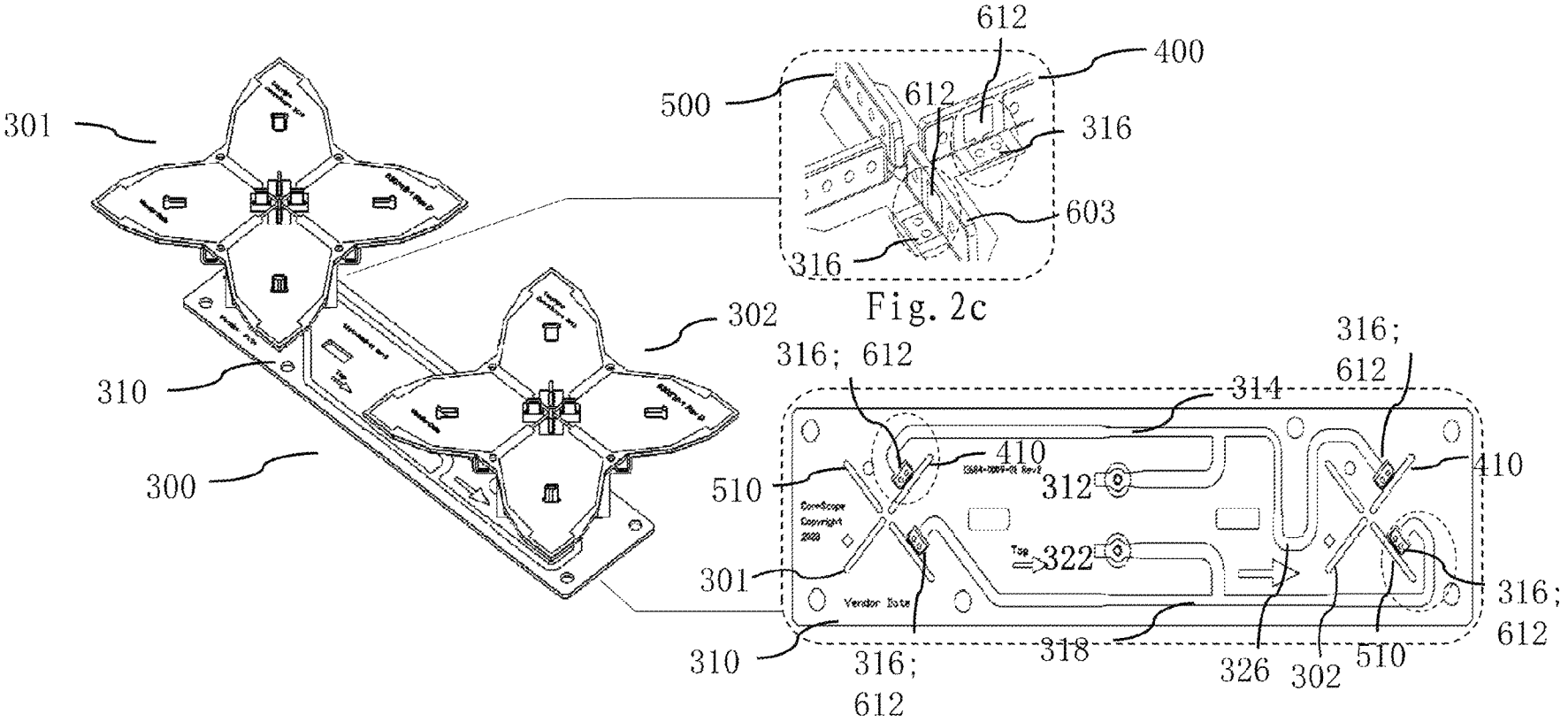
FIG. 2*a* is a schematic front perspective view of an antenna assembly of the base station antenna.
FIG. 2*b* is a schematic front view of the antenna assembly of FIG. 2*a* with the two radiating elements omitted.
FIG. 2*c* is a enlarged rear view of the antenna assembly of FIG. 2*a* illustrating a connection portion between a radiating element and a feed board of the antenna assembly.

FIGS. 2*a* and 2*b* are a schematic front perspective view and a schematic front view, respectively, of an antenna assembly 300 of the base station antenna 100. The antenna assembly 300 includes a feed board 310 and one or more radiating elements that are mounted to extend forwardly from the feed board 310. The radiating elements are omitted in FIG. 2*b* to fully show the front surface of the feed board 310. The feed board 310 may be implemented, for example, using a printed circuit board. In the depicted embodiment, a total of two radiating elements are mounted on the feed board 310, but more or fewer radiating elements may be included in the antenna assembly 300, and any type (or combination of types) of radiating elements may be used. In FIG. 2*a*, the two radiating elements may be referred to as a first radiating element 301 and a second radiating element 302. The radiating elements 301, 302 may each be configured as a dual-polarized radiating element with two dipoles (that is, crossed dipoles or crossed radiators) placed laterally relative to each other to support dual polarization operation.

Each radiating element 301, 302 includes a first feed stalk 400, a first radiator 410 mounted on the first feed stalk 400, a second feed stalk 500, and a second radiator 510 mounted on the second feed stalk 500. The first radiator 410 and the first feed stalk 400 may transmit and receive RF signals having a first polarization (for example, +45° polarization), while the second radiator 510 and the second feed stalk 500 may transmit and receive RF signals having a second polarization (for example, −45° polarization).

Figures 3A, 3B:
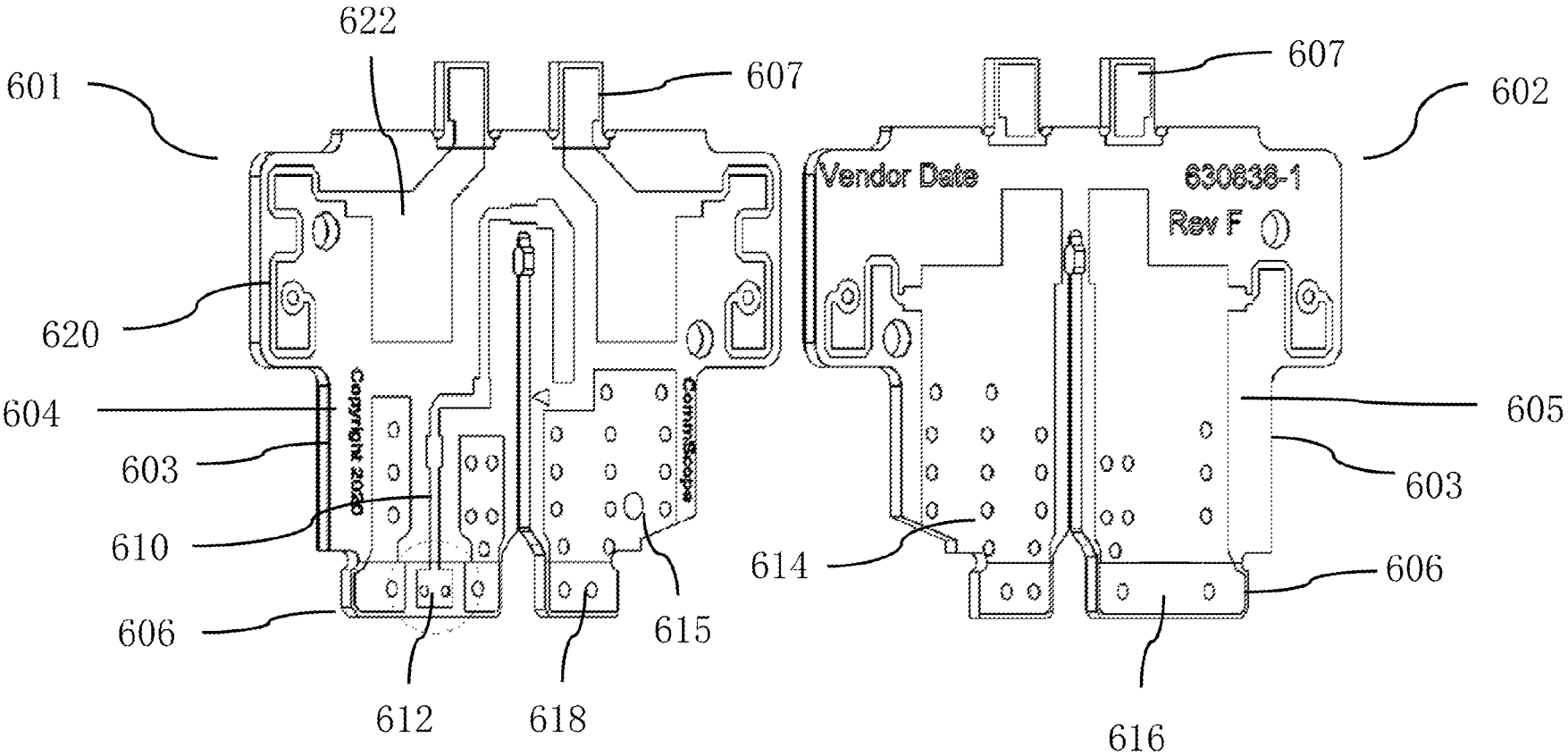
FIG. 3*a* is a schematic view showing a first major surface of one of the feed stalks of one of the radiating elements included in the antenna assembly of FIG. 2*a;*
FIG. 3*b* is a schematic view showing a second major surface of the feed stalk of FIG. 3*a;*

Referring to FIGS. 3*a* and 3*b*, where FIG. 3*a* is a schematic view showing a first major surface 601 of the feed stalk 400 of radiating element 301, and FIG. 3*b* is a schematic view showing a second major surface 602 of the feed stalk 400. Feed stalk 500 may be very similar to feed stalk 400 and hence is not pictured separately. Moreover, the feed stalks 400, 500 of radiating element 302 may be identical to the feed stalks 400, 500 of radiating element 301, and hence are not pictured separately. The feed stalks 400, 500 may each be implemented using a printed circuit board. Each printed circuit board may include a dielectric substrate 603, a first metal pattern 604 printed on the first major surface 601 of the dielectric substrate 603, and a second metal pattern 605 printed on the second major surface 602 of the dielectric substrate 603 that is opposite the first major surface 601.

As shown in FIG. 3*a*, the first metal pattern 604 may include a first feed transmission line 610 and a first feed welding region 612. The first feed transmission line 610 may be configured as a feed balun and is electrically connected to the first feed welding region 612. In the depicted embodiment, the first feed transmission line 610 is printed integrally with the first feed welding region 612. The first feed welding region 612 may be provided on a support end 606, located opposite a feed end 607, of the feed stalk 400. The radiator may be mounted on the feed end 607, and the radiating element 301 may be mounted onto the feed board 310 by means of the support end 606. The first feed welding region 612 may be configured to be electrically connected with the feed transmission lines 314 and 318 on the feed board 310.

As shown in FIG. 3*b*, the second metal pattern 605 may include a ground metal region 614 and a first ground welding region 616. The ground metal region 614 forms a return path for the RF signals, and may interact with the first feed transmission line 610 on the first metal pattern 604 to achieve effective transmission of the RF signals on the feed stalk 400. The ground metal region 614 may be electrically connected to the first ground welding region 616. In the depicted embodiment, the ground metal region 614 is printed integrally with the first ground welding region 616. The first ground welding region 616 may be disposed on the support end 606 of the feed stalk to be electrically connected with a ground pad on the feed board 310. Additionally or alternatively, the first metal pattern 604 may further include an additional ground metal region 615 and an additional ground welding region 618, both of which may be electrically connected to the ground metal region 614 and the first ground welding region 616 on the second metal pattern 605 via metallized holes through the dielectric substrate 603, respectively. Additionally or alternatively, the first metal pattern 604 and the second metal pattern 605 may further include an inductive element 620 and a capacitive element 622, which may be configured as a filter circuit. In the depicted embodiment, the ground metal region 614 is electrically connected to the feed end 607 of the feed stalk 400, 500 via an inductive-capacitive (LC) filter circuit, and the dipole arms of the radiator 410, 510 are mounted on and electrically connected to the feed end 607.

The lowermost portion of the support end 606 that includes the first feed welding region 612, the additional ground welding region 618 and the first ground welding region 616 may be inserted through slots 408 in the feed board 310 so that distal portion of the support end 606 is behind the feed board 310 when the feed assembly 300 is full assembled. The remainder of the feed stalk 400 projects forwardly from a front surface of the feed board 310.

As shown in FIG. 2*b*, the feed board 310 includes a first RF feed source 312, a second feed transmission line 314 electrically connected to the first RF feed source 312, and one or more pad regions 316 that are electrically connected to the second feed transmission line 314, as well as a second RF feed source 322, a third feed transmission line 318 electrically connected to the second RF feed source 322, and one or more pad regions 316 electrically connected to the third feed transmission line 318. The above components of the feed board 310 may be implemented as a printed metal pattern on the front surface of the printed circuit board that implements the feed board 310. The first RF feed source 312 may serve as an input/output of the feed board 310 for RF signals having the first polarization (for example, +45° polarization), while the second RF feed source 322 may serve as an input/output of the feed board 310 for RF signals having the second polarization (for example, −45° polarization). Referring to FIG. 2*c*, the rear side of the feed board 310 includes a metal pattern that includes one or more ground pads as well as feed welding regions 317 that are separated and electrically isolated from the one or more ground pads by regions where no metallization is provided. Each feed welding region 317 is electrically connected to a respective one of the pad regions 316 via metallized holes through the dielectric substrate of the feed board 310.

Referring to FIGS. 2*b* and 2*c*, the first RF feed source 312 may be electrically connected to the first feed stalk 400 of the first radiating element 301 via a first branch of the second feed transmission line 314. Specifically, the first RF feed source 312 may be electrically connected to the first feed welding region 612 on the first feed stalk 400 (see FIGS. 3*a*, 3*b*) via the first branch of the second feed transmission line 314, and the pad region 316, metallized vias and feed welding region 317 on the feed board 310, and the ground pad on the rear side of the feed board 310 may be welded to the ground welding region (the first ground welding region 616 and/or the additional ground welding region 618) on the first feed stalk 400. In this way, RF signals having the first polarization may be transmitted from the first RF feed source 312 to the first radiator 410 of the first radiating element 301 or from the first radiator 410 to the first RF feed source 312. The second RF feed source 322 may be electrically connected to the second feed stalk 500 of the first radiating element 301 via a first branch of the third feed transmission line 318. Specifically, the second RF feed source 322 may be electrically connected to the first feed welding region 612 on the second feed stalk 500 via the first branch of the third feed transmission line 318 and the pad region 316, metallized vias and feed welding region 317 on the feed board 310, and the ground pad on the rear side of the feed board 310 may be welded to the ground welding region on the second feed stalk 500. In this way, RF signals having the second polarization may be transmitted from the second RF feed source 322 to the second radiator 510 of the first radiating element 301 or from the second radiator 510 to the second RF feed source 322. Likewise, the first RF feed source 312 may be electrically connected to the first feed stalk 400 of the second radiating element 302 via a second branch of the second feed transmission line 314, so that the RF signals of the first polarization may be transmitted from the first RF feed source 312 to the first radiator 410 of the second radiating element 302 or from the first radiator 410 of the second radiating element 302 to the first RF feed source 312. The second RF feed source 322 may be electrically connected to the second feed stalk 500 of the second radiating element 302 via a second branch of the third feed transmission line 318, so that the RF signals of the second polarization may be transmitted from the second RF feed source 322 to the second radiator 510 of the second radiating element 302 or from the second radiator 510 of the second radiating element 302 to the second RF feed source 322.

Based on the operating principle of the dual-polarized radiating element, the first feed welding regions 612 on the crossed feed stalks (e.g., the first feed stalk 400 and the second feed stalk 500) have to be spaced apart from each other by the dielectric substrate 603, and in some embodiments, may be oriented opposite to each other relative to the direction of longitudinal axis L. In other words, the first feed welding region 612 on the first feed stalk 400 may be located on an upper side of the first feed stalk 400, i.e. being oriented towards a top end cover of the radome, whereas the first feed welding region 612 on the second feed stalk 500 may be located on a lower side of the second feed stalk 500, i.e. being oriented towards a bottom end cover of the radome; or vice versa. As shown in FIGS. 2*b* and 2*c*, the first feed welding region 612 on the first feed stalk 400 is spaced apart from the first feed welding region 612 on the second feed stalk 500 by the dielectric substrate 603. Therefore, in order to feed the crossed feed stalks, the feed transmission lines 314, 318 on the feed board 310 have to go a long way and extend up to the side of the feed stalk with the first feed welding region 612, where the feed welding region 316 on the feed board 310 is welded with the first feed welding region 612 on the feed stalk. In the current illustration, for example, the first branch of the second feed transmission line 314 on the feed board 310 has to go a long way and extends up to the first feed welding region 612 on the first feed stalk 400 of the first radiating element 301. In order to maintain the predetermined phase difference, the second branch of the second feed transmission line 314 on the feed board 310 has to increase the transmission path length as well (for example, adding a meandered line 326) and extends up to the first feed welding region 612 on the first feed stalk 400 of the second radiating element 302. However, the feed networks according to FIGS. 2*b* and 2*c* are disadvantageous in that: firstly, the feed networks on the feed board 310 are relatively complex, and thus have high routing difficulty; secondly, the meandered transmission line 326 may form an undesirable inductance effect, which may affect the transmission performance of the RF signals to thereby affect the RF performance such as beamforming performance of the base station antenna 100; thirdly, the size of the feed board 310 is increased, making the base station antenna 100 larger and heavier, and thus limited by wind loading, manufacturing cost, and industry regulations.

Figures 4A, 4B:
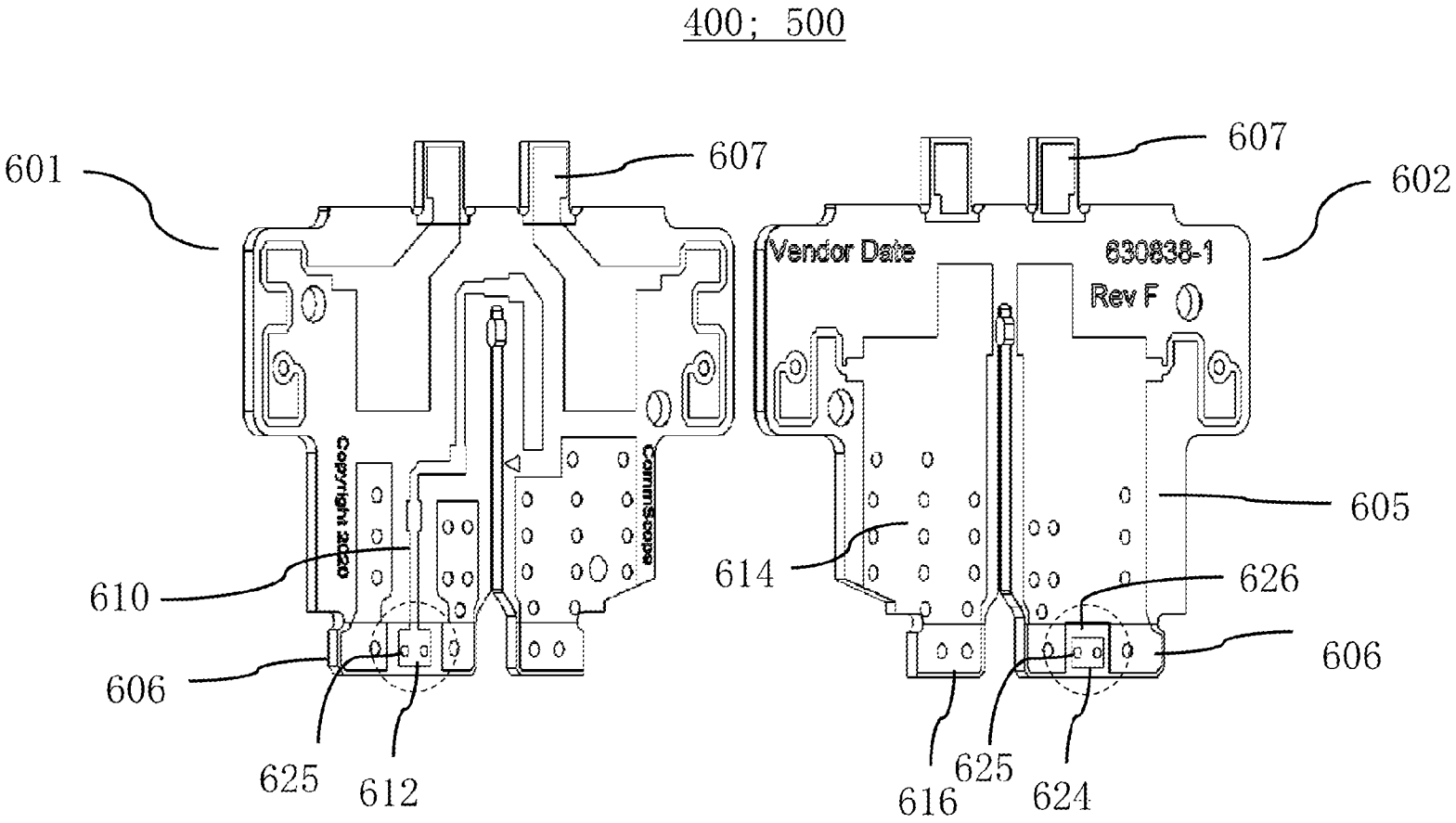
FIG. 4*a* is a schematic view showing a first major surface of the feed stalk of a radiating element according to some embodiments of the present invention.
FIG. 4*b* is a schematic view showing a second major surface of the feed stalk of FIG. 4*a;*
Figure 5:
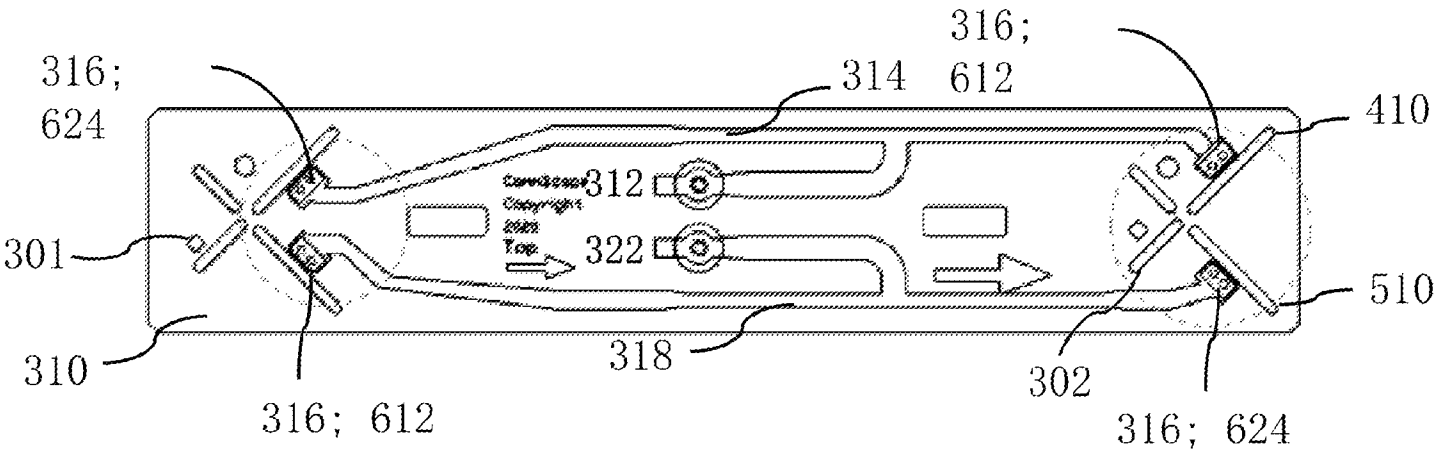
FIG. 5 is a schematic front view of an antenna assembly according to some embodiments of the present invention.

Next, an antenna assembly 300' according to embodiments of the present invention will be described in detail with reference to FIGS. 4*a*, 4*b* and 5. The antenna assembly 300' includes a feed board 310' and radiating elements 301', 302'. FIG. 4*a* is a schematic view showing the first major surface 601 of a feed stalk 400' according to some embodiments of the present invention that may be used in the radiating elements 301', 302'; FIG. 4*b* is a schematic view showing the second major surface 602 of the feed stalk 400' according to some embodiments of the present invention; and FIG. 5 is a schematic front view of the antenna assembly 300'.

It should be understood that the elements that were described in detail with reference to FIGS. 2*a*, 2*b*, 2*c*, 3*a*, and 3*b* may be applicable to the antenna assembly 300' and its radiating elements 301', 302' that are described with reference to FIGS. 4*a*, 4*b*, and 5, and thus further description of like elements will not be repeated. Only the differences between the radiating elements 301', 302' according to some embodiments of the present invention and the radiating elements 301, 302 will be explained in detail below.

As shown in FIGS. 4*a* and 4*b*, the first metal pattern 604 printed on the first major surface 601 of the dielectric substrate 603 has the first feed welding region 612, and the second metal pattern 605 printed on the second major surface 602 of the dielectric substrate 603 has a second feed welding region 624, which may be electrically connected to the first feed welding region 612 via a metalized hole 625, so that RF signals may be transmitted from the second feed welding region 624 to the first feed welding region 612, or vice versa. The first feed welding region 612 and the second feed welding region 624 may both be provided on the support end 606 of the feed stalk 400, 500, by means of which the feed stalk is mounted on the feed board 310'. Thus, the first feed welding region 612 and the second feed welding region 624 are provided close to the feed board 310', which facilitates welding to the feed welding region 316 on the feed board 310'. In order to reserve a space for the second feed welding region 624 on the second metal pattern 605, a region of certain size may be etched within the original ground metal region 614 and/or the original first ground welding region 616. The second feed welding region 624 may be printed in the etched region, and spaced apart from the ground metal region 614 and the first ground welding region 616 by a gap 626, within which metallization is removed, so that the second feed welding region 624 is electrically isolated from the ground metal region 614 and the first ground welding area 616.

As the two major surfaces 601, 602 of the feed stalk 400' of the radiating elements 301', 302' are both provided with feed welding regions (i.e., the first and second feed welding regions 612, 624), the welding of the feed stalk 400' with the feed board 310' may be flexibly selected to be performed at either or both of the two major surfaces, thereby potentially eliminating any need for the feed transmission lines 314, 318 from going a long way and being wired meanderingly on the feed board 310'.

As shown in FIG. 5, the second feed welding region 624 is closer to the first RF feed source 312 than is the first feed welding region 612. As such, the first branch of the second feed transmission line 314 may be welded to the second feed welding region 624 rather than having to extend a long distance to be welded to the first feed welding region 612 on the first major surface 601 of the first feed stalk 400'. Likewise, as the second feed welding region 624 (compared with the first feed welding region 612) on the second feed stalk 500' of the second radiating element 302 is closer to the second RF feed source 322, the second branch of the third feed transmission line 318 may be welded to the second feed welding region 624 through the feed welding region, rather than having to extend a long distance to be welded to the first feed welding region 612 on the first major surface 601 of the second feed stalk 500'. Further, the first feed welding region 612 (compared with the second feed welding region 624) on the second feed stalk 500' of the first radiating element 301 is closer to the second RF feed source 322, and the first feed welding region 612 (compared with the second feed welding region 624) on the first feed stalk 400' of the second radiating element 302 is closer to the first RF feed source 312, so the welding between the corresponding feed stalks and the feed board 310' may still be performed at the first major surface 601.

In the radiating element according to embodiments of the present invention, the first feed welding region 612 on one of the first feed stalk 400' and the second feed stalk 500' is disposed facing the second feed welding region 624 on the other feed stalk, that is, the two feed welding regions 612, 624 are not spaced apart from each other by the dielectric substrate 603, and in some embodiments may be oriented in the same direction with respect to the direction of the longitudinal axis L. In other words, the first feed welding region 612 on the first feed stalk 400' may be located on the upper side of the first feed stalk 400', and the second feed welding region 624 on the second feed stalk 500' may also be located on the upper side of the second feed stalk 500', that is, they are both oriented towards the top end cover of the radome; alternatively, the first feed welding region 612 on the first feed stalk 400' may be located on the lower side of the first feed stalk 400', and the second feed welding region 624 on the second feed stalk 500' may also be located on the lower side of the second feed stalk 500', that is, they are both oriented towards the bottom end cover of the radome.

It should be understood that the design of the first metal pattern 604 and/or the second metal pattern 605 on the feed stalks 400', 500' of radiating elements 301', 302', for example, the number and arrangement of the corresponding feed welding region 612, 624, the ground welding region 616, 618 and/or of the ground metal region 614 may exhibit various modifications, not limited to the present embodiment.

In some embodiments, the first metal pattern 604 may include a plurality of first feed welding regions 612, the second metal pattern 605 may include a plurality of second feed welding regions 624, and the first feed welding region 612 and/or the second feed welding region 624 may also have any shape.

Although exemplary embodiments of this disclosure have been described, those skilled in the art should appreciate that many variations and modifications are possible in the exemplary embodiments without materially departing from the spirit and scope of the present disclosure. Accordingly, all such variations and modifications are intended to be included within the scope of this disclosure as defined in the claims. The present disclosure is defined by the appended claims, and equivalents of these claims are also contained.

What is claimed is:

1. A radiating element, comprising:

a feed stalk; and a radiator mounted on the feed stalk, wherein the feed stalk includes a dielectric substrate, a first metal pattern printed on a first major surface of the dielectric substrate, and a second metal pattern printed on a second major surface of the dielectric substrate that is opposite the first major surface, and wherein the first metal pattern includes a first feed transmission line, and a first feed welding region electrically connected to the first feed transmission line, and the second metal pattern includes a second feed welding region electrically connected to the first feed welding region.

2. The radiating element according to claim 1, wherein the first feed welding region is electrically connected to the second feed welding region via a metalized hole through the dielectric substrate.

3. The radiating element according to claim 1, wherein the first feed welding region and the second feed welding region are provided on a support end of the feed stalk, wherein the feed stalk is configured to mount to a feed board for the radiating element via the support end, and wherein the first feed welding region and the second feed welding region are configured to be welded to a feed board feed welding region on the feed board.

4. The radiating element according to claim 1, wherein the first feed transmission line is configured as a feed balun.

5. The radiating element according to claim 4, wherein the feed balun is printed integrally with the first feed welding region.

6. The radiating element according to claim 1, wherein the feed stalk includes a first feed stalk and a second feed stalk, wherein the radiator includes a first radiator mounted on the first feed stalk and a second radiator mounted on the second feed stalk, wherein the first feed stalk and the second feed stalk are arranged crosswise, and wherein the first feed welding region on one of the first feed stalk and the second feed stalk is arranged facing the second feed welding region on the other feed stalk.

7. The radiating element according to claim 1, wherein the second metal pattern includes a first ground welding region, and a ground metal region electrically connected to the first ground welding region.

8. The radiating element according to claim 7, wherein the second feed welding region is spaced apart from the first ground welding region and the ground metal region by a gap, within which metallization is removed, so that the second feed welding region is electrically isolated from the first ground welding region and the ground metal region.

9. The radiating element according to claim 7, wherein the first ground welding region and the second feed welding region are arranged side by side.

10. The radiating element according to claim 7, wherein the first ground welding region is provided on a support end of the feed stalk, and the feed stalk is configured to mount on a feed board for the radiating element via the support end, and wherein the first ground welding region is configured to be welded to a ground pad on the feed board.

11. The radiating element according to claim 7, wherein the ground metal region is printed integrally with the first ground welding region.

12. The radiating element according to claim 7, wherein the first feed transmission line is configured as a feed line for RF signals and the ground metal region is configured as a return line for RF signals.

13. The radiating element according to claim 7, wherein the ground metal region is electrically connected to a feed end of the feed stalk via an inductive-capacitive filter circuit, and the feed end is welded to the radiator.

14. An antenna assembly, comprising:

a feed board; and a radiating element mounted on the feed board, the radiating element comprising:

a first feed stalk, a first radiator mounted on the first feed stalk, a second feed stalk, and a second radiator mounted on the second feed stalk, wherein the first feed stalk and the second feed stalk each include a dielectric substrate, wherein a first metal pattern is printed on a first major surface of the dielectric substrate and a second metal pattern is printed on a second major surface of the dielectric substrate opposing the first major surface, wherein the first metal pattern includes a first feed transmission line and a first feed welding region electrically connected to the first feed transmission line, wherein the second metal pattern includes a second feed welding region electrically connected to the first feed welding region, and wherein the first feed welding region on one of the first feed stalk and the second feed stalk faces the second feed welding region on the other feed stalk.

15. The antenna assembly according to claim 14, wherein the feed board is provided thereon with a first RF feed source and a second RF feed source; the antenna assembly further comprising:

a second feed transmission line electrically connected to the first RF feed source;

a first feed board feed welding region electrically connected to the second feed transmission line;

a third feed transmission line electrically connected to the second RF feed source; and a second feed board feed welding region electrically connected to the third feed transmission line, wherein the first feed welding region on one of the first feed stalk and the second feed stalk is welded to the first feed board feed welding region on the feed board, and wherein the second feed welding region on the other feed stalk is welded to the second feed board feed welding region on the feed board.

16. The antenna assembly according to claim 14, wherein the first feed welding region is electrically connected to the second feed welding region via a metalized hole.

17. The antenna assembly according to claim 14, wherein the first feed transmission line is configured as a feed balun.

18. The antenna assembly according to claim 14, wherein the second metal pattern includes a first ground welding region and a ground metal region electrically connected to the first ground welding region, and the second feed welding region is spaced from the first ground welding region and the ground metal region by a gap, within which metallization is removed, so that the second feed welding region is electrically isolated from the first ground welding region and the ground metal region.

19. The antenna assembly according to claim 18, wherein the feed board is printed thereon with ground pads, to which the first ground welding region on each of the first feed stalk and the second feed stalk is welded.

20. The antenna assembly according to claim 19, wherein each of the ground pads is electrically connected to a ground metal layer on the feed board.

* * * * *